US007928834B2

(12) United States Patent
Schulze et al.

(10) Patent No.: US 7,928,834 B2
(45) Date of Patent: Apr. 19, 2011

(54) PRESENCE REPRESENTATION DEVICE

(75) Inventors: Jack Schulze, London (GB); Matthew William Webb, London (GB)

(73) Assignee: Schulze & Webb Ltd., London (GB)

( * ) Notice: Subject to any disclaimer, the term of this patent is extended or adjusted under 35 U.S.C. 154(b) by 259 days.

(21) Appl. No.: 11/604,927

(22) Filed: Nov. 28, 2006

(65) Prior Publication Data

US 2008/0122647 A1 May 29, 2008

(51) Int. Cl.
*G08B 9/00* (2006.01)

(52) U.S. Cl. ..... 340/286.02; 340/286.01; 340/286.03; 340/286.11; 340/815.4; 340/815.5; 348/14.1; 348/14.05

(58) Field of Classification Search ..... 340/286.02, 340/286.01, 286.03, 815.4, 815.5, 815.58, 340/825.52, 286.11; 348/14.05, 14.1; 345/156; 700/245; 710/1

See application file for complete search history.

(56) References Cited

U.S. PATENT DOCUMENTS

| | | | | |
|---|---|---|---|---|
| 6,292,713 | B1 * | 9/2001 | Jouppi et al. | 700/245 |
| 6,728,754 | B1 * | 4/2004 | Lipton | 709/203 |
| 2003/0038773 | A1 * | 2/2003 | Goldberg et al. | 345/156 |
| 2004/0103222 | A1 * | 5/2004 | Carr et al. | 710/1 |
| 2005/0110867 | A1 * | 5/2005 | Schulz | 348/14.05 |

OTHER PUBLICATIONS

Internet page, http://new.nabaztag.com/en/index.html, 2006, 1 pg.
Internet page, http://ambientdevices.com/cat/dashboard/index/html, 2006, 2 pg.

* cited by examiner

*Primary Examiner* — George A Bugg
*Assistant Examiner* — Sisay Yacob
(74) *Attorney, Agent, or Firm* — Harrington & Smith

(57) ABSTRACT

A device for providing a representation of the presence state of a remote party, the device being responsive, when the presence state of a remote party changes, to move from a first mechanical configuration to a second mechanical configuration, the device preferably comprising a puppet portion in the form of a humanoid which can be moved between a standing and another position.

8 Claims, 5 Drawing Sheets

PRESENCE REPRESENTATION DEVICE

FIELD OF THE INVENTION

The present invention relates to providing a representation of the presence state of a remote party, having particular, but not exclusive, applicability to instant messaging. Presence is also known as telepresence.

BACKGROUND AND SUMMARY OF THE INVENTION

In the context of instant messaging applications, it is well-known for an instant messaging client running on a user device, typically a PC or a mobile telephone, to display an indicator icon and/or text descriptions which visually convey to a user the presence state of other users in the user's list of chat partners. Example presence states include "available", "chat", "busy", "away", "do not disturb" and "out for lunch". It is also known to provide an audible notification when the presence state of a chat partner changes.

An aim of the present invention is to enrich the user-experience value of presence.

According to a first aspect of the invention, the present invention may provide a device for providing a representation of the presence state of a remote party, the device being responsive, when the presence state of a remote party changes, to move from a first mechanical configuration to a second mechanical configuration.

By providing a representation device which has a distinct mechanical manifestation in the real world, the present invention departs markedly from the existing paradigm in which the I/O devices inherent to a user device are used. In so doing, the potential for a range of different and richer user experiences is opened up.

In one preferred embodiment, the representation device includes a puppet portion in the form of a humanoid which can be moved between a position where it stands erect and another position. The effect when the humanoid figure moves from a slumped or lying position to a position of attention is very pleasing from the user experience point of view. Animals or other higher life forms, whether real or fictional, can also make for an emotionally-pleasing puppet portion.

Preferably, the representation device comprises a base portion on which the puppet portion is located, the puppet portion comprising a plurality of body segments through which a control string is threaded, wherein at least one end of the control string passes into the base portion for coupling to a control unit in the base portion. This form of structure is simple and easy to manufacture, and enables a large range of puppet figures to be designed, for example, using a mix of mass-produced and custom-made parts. Furthermore, the puppet portion is easily controlled as described later.

Preferably, the control unit includes means for controlling the length of the string which is available to pass through the puppet portion. By simply adjusting this available length, the posture/configuration of the puppet portion can be radically adjusted.

Preferably, the representation device comprises an interface enabling local communication with a user device. The interface can be a USB interface and the connection made through a USB connector and lead, or the interface can be a Bluetooth or WiFi interface and the connection achieved wirelessly.

Preferably, the representation device comprises means for storing an identity corresponding to the remote party to whom it is responsive. It is preferred that the representation device uniquely corresponds to one remote party, but it may also store and respond to more than one.

In one embodiment, the representation device is responsive to a signal indicative of the presence state of a remote party, wherein said signal comprises an instruction to move between said mechanical configurations. In other embodiments, said signal comprises presence state information, including identity information and possibly other presence state attributes such as user mood, location, etc.

According to a second aspect of the invention, the present invention may comprise a user device capable of communication over a network and running an application supporting presence functionality, the device including an interface for communicating with local devices, wherein the user device is responsive to a first signal which is received over the network and indicative of the presence state of a remote party to transmit, over said interface, a second signal indicative of the presence state of a remote party to a local device for providing a representation to the user of the presence state of the remote party.

By delegating the representation of the presence state of a remote party to another local device, the user device of the present invention need not rely on the I/O devices inherent to the user device, but instead may draw on the resources of another local device. In so doing, the potential for a range of different and richer user experiences is opened up.

Preferably, the user device comprises means for storing identity information of a remote party corresponding to a said representation device. In some embodiments, information for more than one representation device may be stored in a watch list.

The first and second signals may directly convey the presence state of the remote party, or may indirectly convey the presence state by signalling a change in presence state from which the presence state can be inferred.

Preferably, the user device includes means for comparing presence state information derived from the first signal with said stored identity information to determine whether to send said second signal. The second signal may comprise a move instruction for a said representation device.

According to a third aspect of the invention, the present invention may comprise a computer program for a user device capable of communication over a network and running an application supporting presence functionality and including an interface for communicating with local devices, the computer program being responsive to a first signal which is received over the network and indicative of the presence state of a remote party to transmit, over said interface, a second signal indicative of the presence state of a remote party to a local device for providing a representation to the user of the presence state of the remote party.

According to a fourth aspect of the invention, the present invention may comprise a data carrier bearing a computer program according to the third aspect of the invention.

BRIEF DESCRIPTION OF THE DRAWINGS

Exemplary embodiments of the invention are herein described with reference to the accompanying drawings, in which.

DETAILED DESCRIPTION OF THE DRAWINGS

Figure 1:
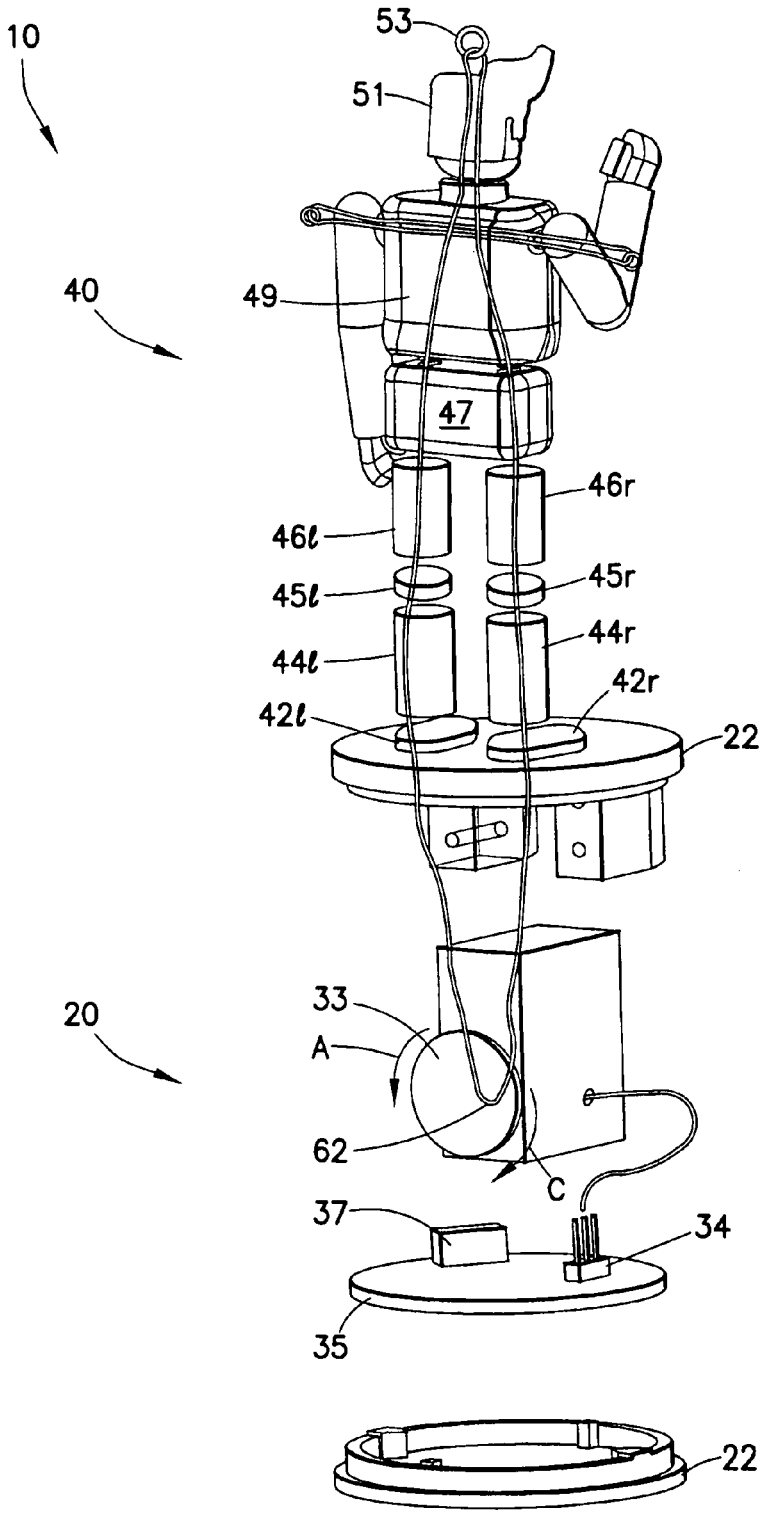
FIG. 1 shows a view of a representation device in accordance with an embodiment of the invention with some parts exploded.

A device for providing a representation of the presence state of a remote party in accordance with an embodiment of the invention is shown in FIG. 1 and is generally designated 10. The representation device 10 comprises a base portion 20 and a puppet portion 40.

Figure 2:
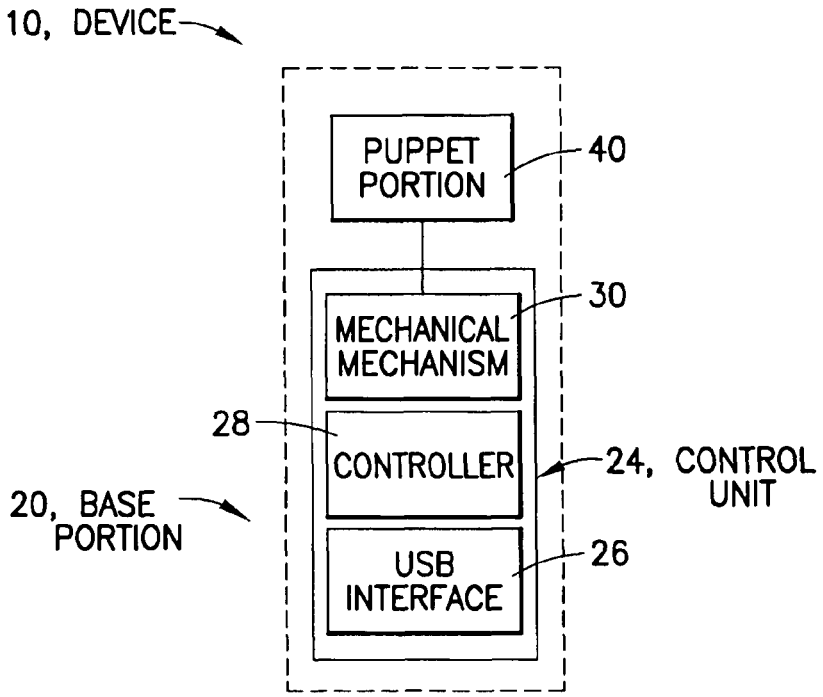
FIG. 2 shows a diagram of the FIG. 1 device in a more abstract and functional form.
Figure 4:
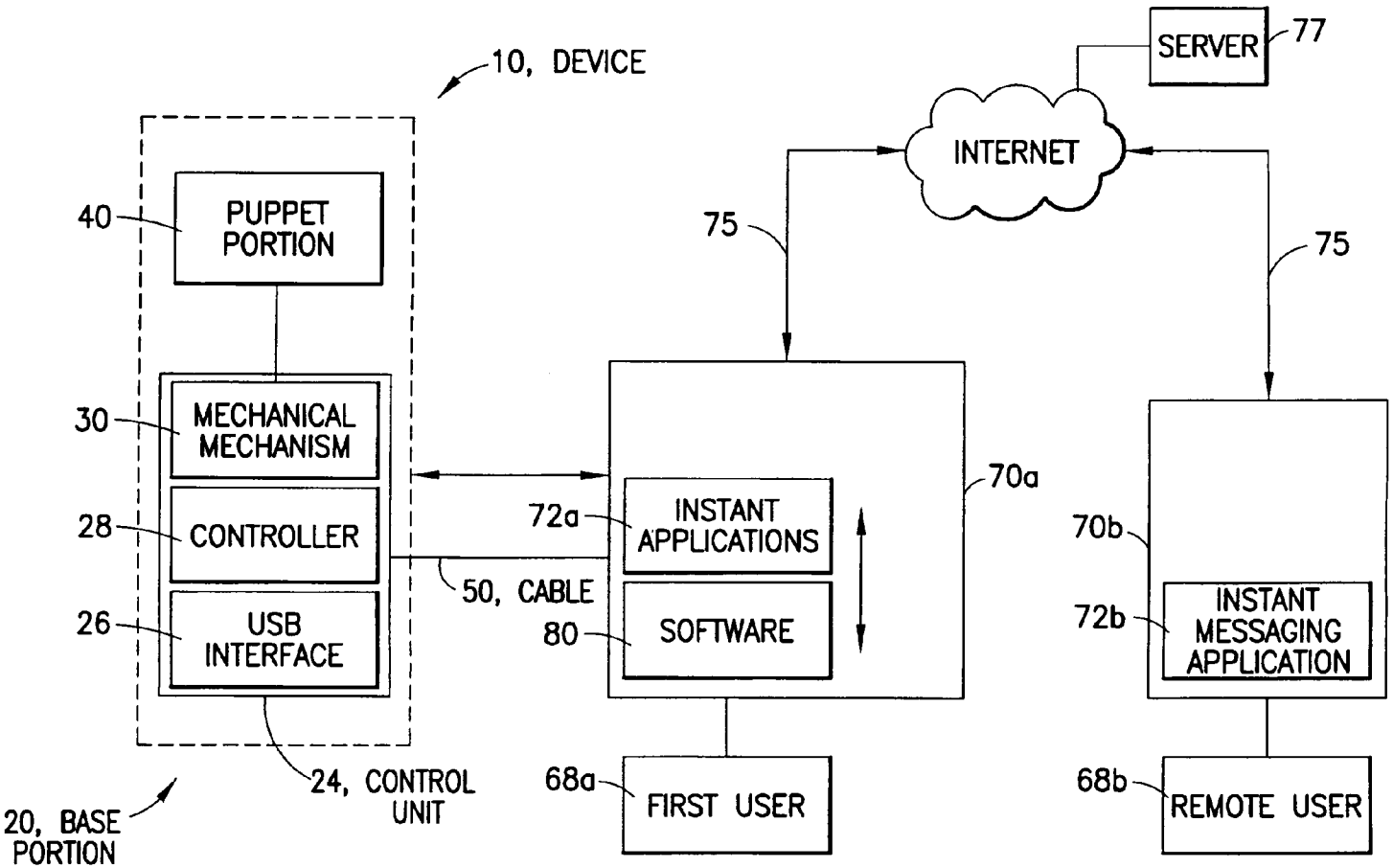
FIG. 4 shows the device of FIG. 1, in use, in a system context.
Figure 5:
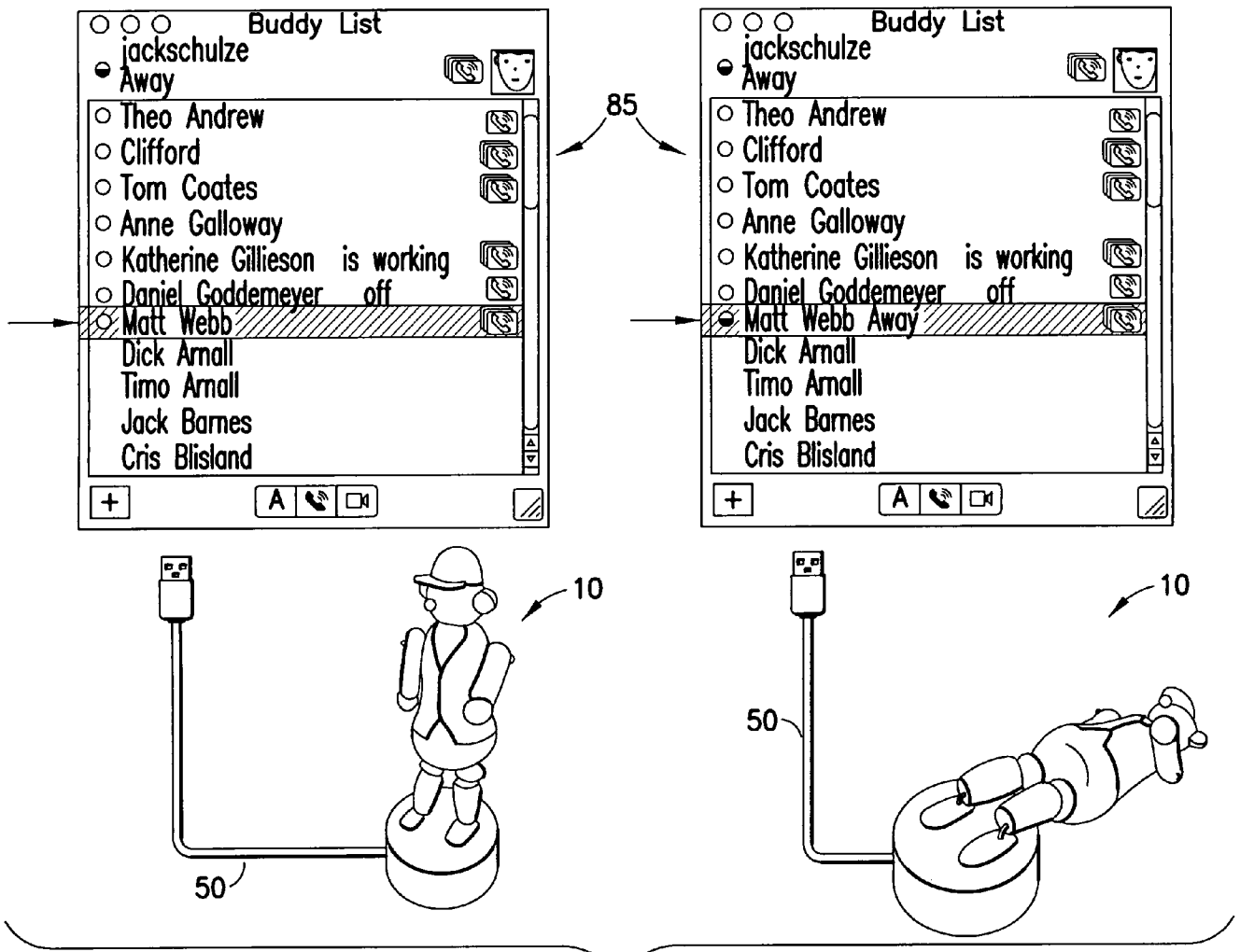
FIG. 5 illustrates the operation of the device of FIG. 1 in conjunction with an instant messaging application.

The base portion 20 comprises a housing 22 within which is located the control unit 24 for the puppet portion 40. Referring to FIG. 2, which shows the device 10 in a more abstract and functional form, the control unit 24 comprises a USB interface 26, including a USB connector 37, by means of which the device 10 can be coupled to and communicate with a PC via a USB cable 50 (as shown in FIG. 4 or 5). The control unit 24 also comprises a controller 28 for co-ordinating the overall operation of the device 10, and particularly directs the operation of the mechanical mechanism 30. In the embodiment shown in FIG. 1, the mechanical mechanism 30 comprises a servo-mechanism 32 (hereinafter "servo") which is shown mounted to the inside of the housing and electrically connected to a PCB 35 via a connector 34. The servo 32 has an output shaft 33.

The puppet portion 40 comprises an assembly of body segments arranged to form a conventional humanoid figure. It comprises left and right foot segments 42*l*,42*r* respectively which are fixedly mounted to the top of housing, left and right leg segments 44*l*,45*l*,46*l*, 44*r*,45*r*,46*r* respectively, a waist segment 47, a torso segment 49, and a head segment 51. The head segment 51 further comprises a loop 53 located inside the head segment 51. The loop 53 appears external to the head segment 51 in FIG. 1 for the sake of diagrammatic simplicity only. Each of the body segments 42,44,45,46,47,49,51 include one or more passages through which a single string 60 can be threaded. The string passes from inside the housing 22 through the left foot segment 42*l*, up through the left leg segments 44*l*,45*l*,46*l*, up through the left side of the waist segment 47 and torso segment 49 into the head segment 51 where it passes through the loop 53 and then travels down the right side of the body segments in an analogous fashion to the left side through the right foot segment 42*r* back into the housing 22. In FIG. 1, the puppet portion 40 is shown as including further arm segments which are connected to each other by a separate second string (all without referenced numerals). In this embodiment of the invention, the string 60 is a closed loop which is attached at one point along it to a fixed connection point, designated 62 in FIG. 1, on the output shaft 33.

Figure 3B:
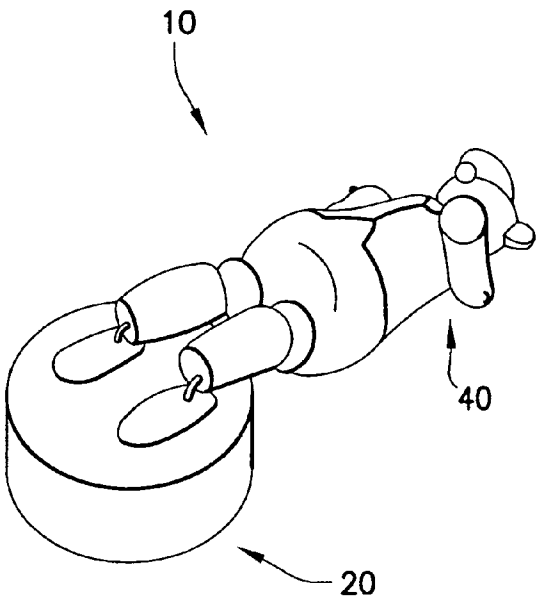
FIGS. 3(*a*) and 3(*b*) show the device of FIG. 1 in two different mechanical configurations.
Figure 3A:
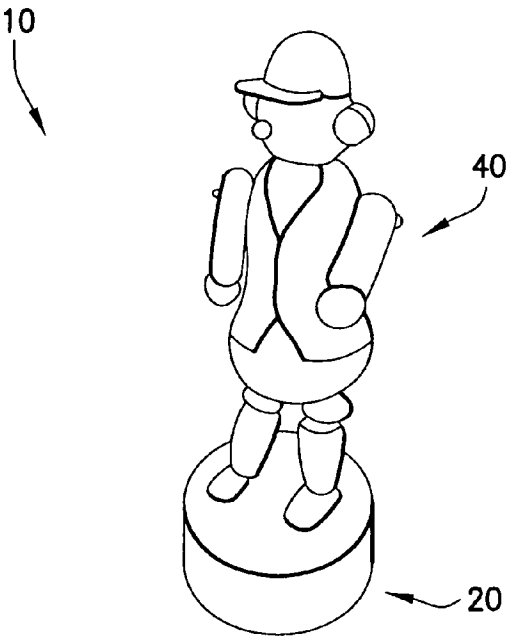

The entrainment of the body segments on the string 60 holds the assembly together. The absolute length of the string is selected such that when the connection point 62 is in a low position, for example, the output shaft 33 of the servo 32 is turned a little further clockwise as per arrow C than it is shown in FIG. 1, the length of string 60 which is available to pass through the puppet portion 40 is at a minimum, and thus the string 60 is held taut between the loop 53 and the shaft 33, whereby the body segments are compelled to align properly and the puppet portion 40 stands erect as shown in FIG. 3(*a*). And when the connection point 62 is in a high position, for example, the output shaft is turned a little further anti-clockwise as per the arrow A than it is shown in FIG. 1, the length of string 60 which is available to pass through the puppet portion 40 becomes longer and thus the string becomes looser, whereby the body segments are more free to move relative to each other, and the puppet portion 40 sags. The way that the puppet portion 40 sags depends on the design of the body segments and the slack in the string which is available. In the example shown in FIG. 3(*b*), the puppet portion 40 adopts a lying position.

Thus, it will be appreciated that by appropriate activation of the servo 32 the puppet portion 40 can be made to move between the FIG. 3(*a*) mechanical configuration in which the puppet portion 40 is standing and the FIG. 3(*b*) mechanical configuration in which the puppet portion 40 is lying.

In other embodiments, the string is not a closed-loop. One end of the string is connected to a fixed point within the base unit 20, for example, on the housing 22 with only the other end being connected to the shaft 33.

The use of a servo 32 is advantageous in that it allows precision control of the output shaft 33 enabling the transition between the standing and lying positions to be varied to create different visual effects with the puppet portion 40. Also, a position intermediate the standing and lying positions can easily be achieved. However, servos can be expensive and cheaper mechanisms can be employed to achieve the requisite control of the string. For example, in another embodiment, a geared motor arrangement is used, which arrangement lacks the positional feedback of a servo with only the shaft speed being controllable. In a further embodiment, a solenoid arrangement is used. This is a cheap option, but the solenoid can be disadvantageous in that it may move very abruptly between the two available positional states and consume power constantly.

In another embodiment, muscle wire is used for the string 60 which has the benefit of eliminating some moving mechanical components.

FIG. 4 shows the device 10 in the system context in which it is used. A first user 68*a*, which is hereinafter also referred to as the local user, has an internet-connected PC 70*a* capable of running an instant messaging application 72*a*. Likewise, in this example, a user 68*b*, which is hereinafter also referred to as the remote user has a similar internet-connected PC 70*b* capable of running an instant messaging application 72*b*. An instant messaging server 77 provides instant messaging services to suitable user devices having the appropriate instant messaging client software.

The PC 70*a* differs from PC 70*b* in that it has additional puppet control software 80 installed. On connection of the device 10 to the PC 70*a* by the USB cable 50, the PC 70*a* identifies the device as a hardware peripheral device as is the normal case for a USB-based connection. Then, the control software 80 recognises the representation device 10 as an already-programmed device and interrogates the device using a contact-retrieve control message/code. In response to that, the controller 28 uploads the identity information which has been pre-programmed into the device. The identity information specifies the identity of the party in the instant messaging context to whom the device 10 should be responsive. On receipt, the control software 80 stores the identity information in a watch list. The watch list comprises the identity information for all the representation devices currently actually connected to the PC 70*a*. In this example, there is only one, but more than one can be used simultaneously. In the latter case, each device corresponds to a different remote party.

Thus, when both users are running the instant applications 72*a*, 72*b* and under the assumptions that (i) the user 68*a* is set up as a watcher for user 68*b* and (ii) user 68*b* has set up his presence state publishing profile to allow his presence state information to be received by the local user 68*a*, the remote user 68*b* on adjusting his presence status to 'available' in the messaging application 72*b* causes the server 77 to publish a change in the presence state of the user 68*b* to all the relevant parties, which because of the assumptions made above includes the user 68*a*. On receipt of this presence information from the server 77, the instant messaging application 72 communicates with the control software 80. The control software 80 then checks whether the incoming presence information relates to any party currently listed in the watch list. If the presence information does relate to a party currently listed in the watch list, then the control software 80 sends an 'up' control signal over the USB connection which instructs the puppet portion 40 to move from the lying position in the right-hand side of the drawing to the standing position in the left hand side by the mechanism previously described. FIG. 5 also shows a view of the buddy list for the local user 68*a*. It will be appreciated that 'Matt Webb' corresponds to the remote user 68*b*.

It is pointed out that the seemingly spontaneous movement of the puppet portion 40 which takes place is a markedly more richer user experience than simply getting a notification on the screen of the PC 70*a*. The applicant believes that this enhanced effect stems from the concrete existence of the puppet portion in the real world. Further, because of the constructional technique used for the puppet portion 40, it is easy to tailor the upper portion 40 to somehow resemble the third party which it represents. A further advantage of this embodiment is that the user is more likely to notice a change in the presence information of a remote party when not seated immediately in front of the screen of the PC 72*a* as he is more likely to catch the movement of the puppet portion 40 in the corner of his eye from a wider range of locations.

When the remote user adjusts his presence status to 'unavailable' the message application 72*b* causes the server 77 to publish a change in the presence state of the user 88*b*. On receipt of this presence information from the server 77 the instant messaging application communicates with the control software 80. On confirming that the presence information does relate to a representation device currently in the watch list, the control software 80 sends a 'down' control signal over the USB connection which instructs the puppet portion to adopt the lying position.

The way that the control software 80 itself is informed of the presence state information depends on the specific instant messaging client solution and the hardware specification of the underlying user device 70*a*. As described above, the instant messaging application 72*a* can be innately designed to signal this information to other application. In another embodiment, the control software 80 may be supplied as a plug-in in the instant messaging application whereby the default operation of the application is modified to incorporate the additional functionality of the control software. In another embodiment, the control software 80 periodically queries the instant messaging application 72*a*. And, in a still further embodiment, the control software 80 interrogates the instant messaging server 77 itself over the internet to get periodic updates of changes in presence state information.

On connection of the device 10 to the PC 70*a*, if the control software 80 determines that the device 10 is a representation device 10 which has not yet been programmed with an identity, then the user 68*a* is given the opportunity to make an association between the device 10 and a remote party in his buddy list. On selection of a buddy, the corresponding instant messaging name and service/network, constituting the identify of the device 10, are downloaded into the memory of the control unit 28.

As an acknowledgement of the successful completion of this operation, the control unit 28 can cause a small movement of the sensor producing a twitch or wiggle in the puppet portion 40.

In the embodiments described above, the role of the representation device 10 might be considered to be that of a slave since it merely stores its own identity, transmits that to the PC 70*a* on request, and otherwise carries out the 'up', 'down' instructions from the PC 70*a*. In other embodiments, some of the functions carried out by the control software 80 are migrated to the controller 28. The PC 70*a* transmits all presence state information received via the internet, as is, to the controller 28 which determines itself whether any motion is required on the part of its own puppet portion 40.

In further embodiments, the user device 70*a* is dispensed with, and the device 10 provided with its own network access functionality and its own, stripped-down, instant messaging client.

In a still further embodiment, the representation device receives presence information in the form of a signal which comes not from a presence server in the internet but from a local device either over a local network or directly in a peer-to-peer fashion.

The user device, instead of a PC, may be a mobile personal device like a laptop, PDA, or a mobile phone.

In the described embodiments, the term 'presence' has been used solely in relation to instant messaging application where presence is already in widespread use. However, in the context of the present invention, presence or telepresence is to be understood in a broader sense to include a user's presence at a particular logical location, or engagement in a particular act, in the online world. For example, presence functionality may be applied to document editing applications. Thus, when a user accesses a shared document, that act of accessing may cause the publication of presence state information to all the other parties collaborating on the document. Alternatively, the act of accessing the document itself may not cause the publication of presence information, but the act of editing it might do so automatically. Alternatively, the editor positively selecting a option may cause presence information to be published. Thus, presence can help to synchronise the editing of documents and avoid lengthy email discussions about what changes to accept. In this type of environment, the present invention is particularly useful. For example, on seeing the presence of a remote editor, the local user may choose to be available to answer editing questions immediately.

The invention claimed is:

1. A device for providing a representation of the presence state of a remote party having associated means for storing an identity corresponding to the remote party, the device being responsive uniquely to the remote party whose identity is stored, when the presence state of a remote party changes, to move from a first mechanical configuration to a second mechanical configuration, said device being further responsive to a user making a successful association between the device and the identity of the remote party to cause a motion of the device that acknowledges to the user the success of the association.

2. The representation device of claim 1, comprising a puppet portion in the form of a humanoid which can be moved between a position where it stands erect and another position.

3. The representation device as in claim 2, comprising a base portion on which the puppet portion is located, the puppet portion comprising a plurality of body segments through which a control string is threaded, wherein at least one end of the control string passes into the base portion for coupling to a control unit in the base portion.

4. The representation device as in claim 3, comprising means for controlling the length of the string which is available to pass through the puppet portion.

5. The representation device as in claim 1, comprising an interface enabling local communication with a user device.

6. A user device capable of communication over a network and running an application supporting presence functionality, the device including an interface for communicating with local devices, wherein the user device is responsive to a first signal which is received over the network and indicative of the presence state of a remote party to transmit, over said interface, a second signal indicative of the presence state of a remote party to a local device for providing a representation to the user of the presence state of the remote party and comprising means for storing identity information of a remote party corresponding to a representation device and means for comparing presence state information derived from the first signal with said stored identity information to determine whether to send said second signal, wherein the representation device is responsive uniquely to the remote party whose identity is stored, said representation device being further responsive to a user making a successful association between the representation device and the identity of the remote party to cause a motion of the representation device that acknowledges to the user the success of the association.

7. A user device comprising a computer program, the computer program capable of communication over a network and running an application supporting presence functionality and including an interface for communicating with local devices, wherein the computer program is responsive to a first signal which is received over the network and indicative of the presence state of a remote party to transmit, over said interface, a second signal indicative of the presence state of a remote party to a local device for providing a representation using a representation device to the user of the presence state of the remote party, wherein the representation device is responsive uniquely to the remote party whose identity is stored in an associated means for storing identity information of the remote party, said representation device being further responsive to a user making a successful association between the representation device and the identity of the remote party to cause a motion of the representation device that acknowledges to the user the success of the association.

8. A device for providing a representation of the presence state of a remote party, the device comprising memory configured to store an identity corresponding to the remote party, the device being responsive uniquely to the remote party whose identity is stored, when the presence state of a remote party changes, to move from a first mechanical configuration to a second mechanical configuration, said device being further responsive to a user making a successful association between the device and the identity of the remote party to cause a motion of the device that acknowledges to the user the success of the association.

* * * * *